US006941960B2

(12) United States Patent
Huang

(10) Patent No.: US 6,941,960 B2
(45) Date of Patent: Sep. 13, 2005

(54) RUNNER LOCK DEVICE FOR UMBRELLA

(76) Inventor: Lu Tsai Huang, P.O. Box 1282, Chang Hua (TW), 500

( * ) Notice: Subject to any disclaimer, the term of this patent is extended or adjusted under 35 U.S.C. 154(b) by 87 days.

(21) Appl. No.: 10/643,454

(22) Filed: Aug. 15, 2003

(65) Prior Publication Data

US 2005/0055957 A1 Mar. 17, 2005

(51) Int. Cl.[7] ..... A45B 25/06; A45B 25/08

(52) U.S. Cl. ..... 135/41; 135/28; 135/39; 135/40

(58) Field of Search ..... 135/28, 37–41

(56) References Cited

U.S. PATENT DOCUMENTS

| | | | | | |
|---|---|---|---|---|---|
| 508,189 | A | * | 11/1893 | Swan | 135/39 |
| 1,236,299 | A | * | 8/1917 | Hart | 135/39 |
| 2,528,003 | A | * | 10/1950 | Katzberg | 135/39 |
| 3,424,180 | A | * | 1/1969 | Andolfi | 135/28 |
| 5,184,639 | A | | 2/1993 | Lee | 135/28 |
| 5,287,869 | A | | 2/1994 | Wu | 135/25.1 |
| 5,398,709 | A | | 3/1995 | Lee | 135/28 |
| 5,964,235 | A | * | 10/1999 | Wang | 135/28 |
| 6,006,771 | A | | 12/1999 | Wu | 135/41 |
| 6,758,229 | B2 | * | 7/2004 | Wang | 135/41 |
| 6,810,895 | B2 | * | 11/2004 | Lin et al. | 135/28 |
| 2002/0179130 | A1 | * | 12/2002 | Ko | 135/39 |
| 2003/0062075 | A1 | * | 4/2003 | Ko | 135/28 |
| 2003/0183261 | A1 | * | 10/2003 | Lee | 135/38 |
| 2004/0011391 | A1 | * | 1/2004 | Lin et al. | 135/28 |
| 2004/0107980 | A1 | * | 6/2004 | Wang | 135/39 |

FOREIGN PATENT DOCUMENTS

| | | | | |
|---|---|---|---|---|
| CH | 621691 | * | 2/1981 | A45B/25/14 |

* cited by examiner

*Primary Examiner*—Robert Canfield
(74) *Attorney, Agent, or Firm*—Charles E. Baxley

(57) ABSTRACT

A runner lock device for umbrella includes a retainer attached onto an outer peripheral portion of a central post, a barrel slidably engaged onto the central post and having an opening to receive the retainer and to latch the barrel to the retainer and to the central post. A sleeve is slidably engaged onto the barrel and has an actuator arranged to engage with the retainer and to disengage the retainer from the barrel when the sleeve is moved relative to the barrel. The retaining device may be easily secured onto the central post, and no holes are required to be formed in the central post, and no spring members or latches are required to be engaged into the central post.

13 Claims, 3 Drawing Sheets

RUNNER LOCK DEVICE FOR UMBRELLA

BACKGROUND OF THE INVENTION

1. Field of the Invention

The present invention relates to a runner lock device, and more particularly to a runner lock device for umbrella.

2. Description of the Prior Art

Typical umbrella devices comprise a runner slidably attached onto a central post, to support ribs or whalebones, and a lock device provided in the central post for locking the runner to the central post.

For example, U.S. Pat. No. 5,184,639 to Lee, U.S. Pat. No. 5,287,869 to Wu, and U.S. Pat. No. 5,398,709 to Lee disclose three of the typical umbrella devices which also comprise a runner slidably attached onto a central post to support ribs or whale bones, and a complicated lock device provided in the central post for locking the runner to the central post.

The lock devices comprise a number of spring members, latches or catches, that are required to be engaged into the central post. However, the central post normally comprise an outer diameter no greater than about 1 cm, such that the spring members and the latches or catches will be difficult to be engaged into the central post.

In addition, the central post should be drilled or formed with a number of openings or holes therein to receive the spring members and the latches or catches, such that the strength of the central post will be greatly decreased.

U.S. Pat. No. 6,006,771 to Wu discloses a further typical umbrella device having a spring catch to be engaged into the central post, for engaging with and for locking the runner to the central post. Similarly, it will be difficult for the workers to engage the spring catch into the central post of the umbrella devices.

The present invention has arisen to mitigate and/or obviate the afore-described disadvantages of the conventional runner lock device for umbrellas.

SUMMARY OF THE INVENTION

The primary objective of the present invention is to provide a runner lock device for umbrella including a hook or retaining member attached to the outer portion of the central post, to engage with and to lock the runner to the central post, and to allow the retaining member to be easily and quickly attached and secured onto the outer portion of the central post.

The other objective of the present invention is to provide a runner lock device including a central post that is not required to be formed with openings or holes therein to receive spring members and latches or catches, such that the strength of the central post will not be decreased.

The further objective of the present invention is to provide a runner lock device including a central post having no spring members and latches or catches to be received or engaged or assembled therein, such that the runner lock device may be easily and quickly attached or secured onto the central post of the umbrella apparatus.

In accordance with one aspect of the invention, there is provided a runner lock device for umbrella comprising a central post including an outer peripheral portion, a retainer device attached onto the outer peripheral portion of the central post, a barrel slidably engaged onto the central post, and including an opening formed therein to receive the retainer device, and thus to latch the barrel to the retainer device and thus to the central post, and a disengaging device for disengaging the retainer device from the barrel, to release the barrel from the central post. The hook or retaining device may be easily and quickly attached and secured onto the outer portion of the central post, and the central post is not required to be formed with openings or holes therein to receive spring members and latches or catches, such that the strength of the central post will not be decreased.

The retainer device includes at least one cavity formed therein, the central post includes at least one projection extended from the outer peripheral portion thereof to engage into the cavity of the retainer device, and to secure the retainer device to the central post. The retainer device includes a ring engaged onto the central post.

The barrel includes a channel formed therein, and communicating with the opening of the barrel, to guide the retainer device into the opening of the barrel. The barrel includes an inclined surface provided in an upper portion of the channel thereof, to guide the retainer device into the channel of the barrel.

The disengaging device includes a sleeve slidably engaged onto the barrel and having an actuator arranged to engage with the retainer device and to disengage the retainer device from the barrel. The barrel includes a groove formed therein and communicating with the opening thereof to slidably receive the actuator of the sleeve. The groove of the barrel includes a width smaller than that of the opening of the barrel, to form at least one seat between the groove and the opening of the barrel, and for engaging with the retainer device. The sleeve includes a recess formed therein and aligned with the opening of the barrel to receive the retainer device.

The barrel includes a limiting device for limiting a movement of the sleeve relative to the barrel. The limiting means includes at least one catch extended from the barrel to engage with the sleeve, and to limit the movement of the sleeve relative to the barrel.

The sleeve includes at least one passage formed therein to slidably receive the catch of the barrel. The passage of the sleeve includes a height greater than that of the catch of the barrel, and thus to slidably receive the catch of the barrel. The sleeve includes at least one blade formed therein and defined by at least one slot, and having the catch extended therefrom.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 2:
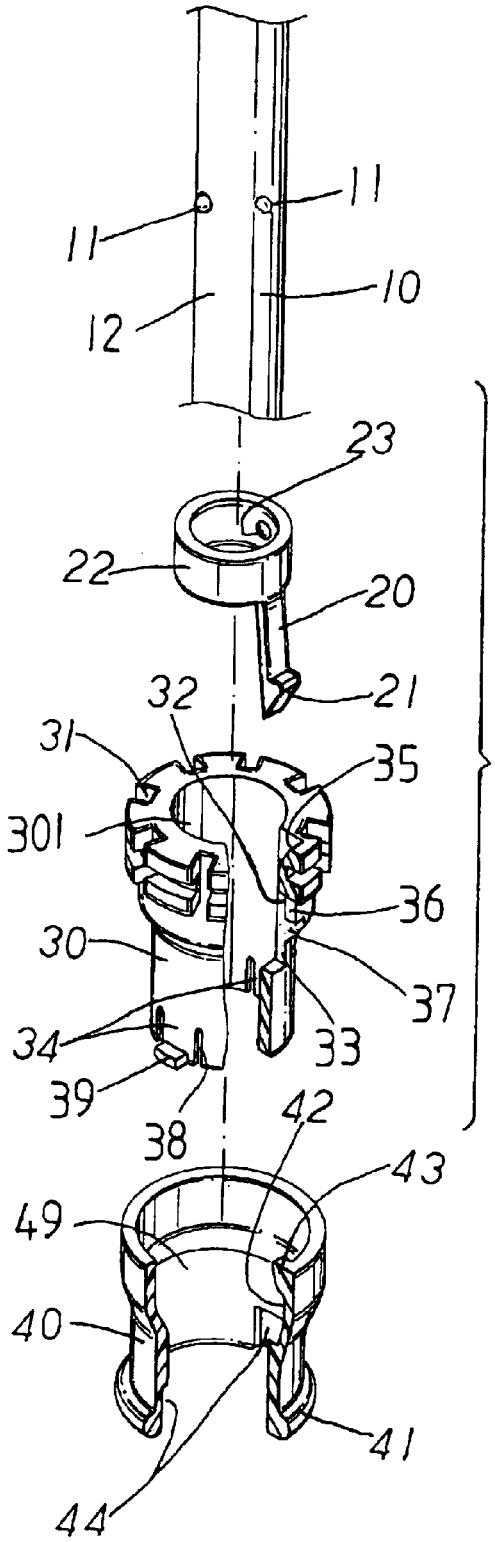
FIG. 2 is a partial exploded view of the runner lock device for umbrella.
Figure 1:
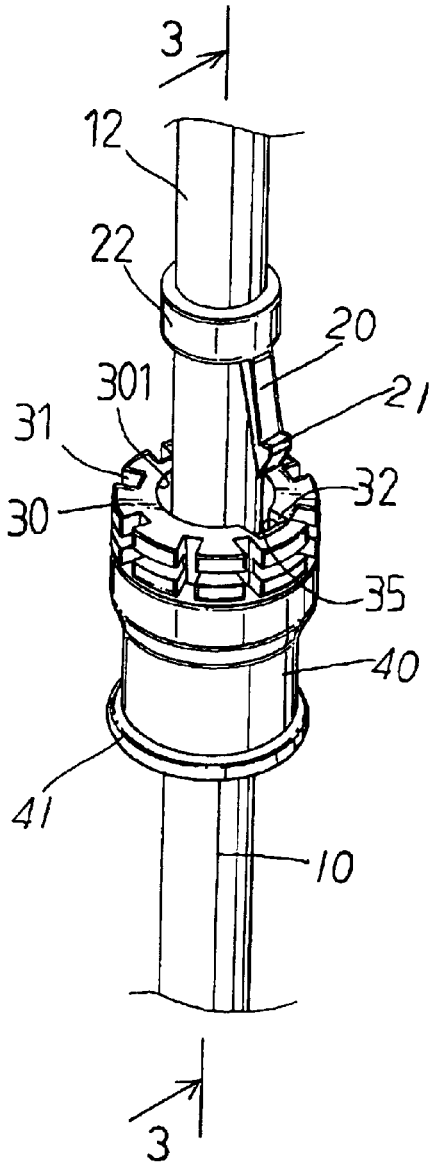
FIG. 1 is a partial perspective view of an umbrella apparatus having a runner lock device in accordance with the present invention.
Figure 3:
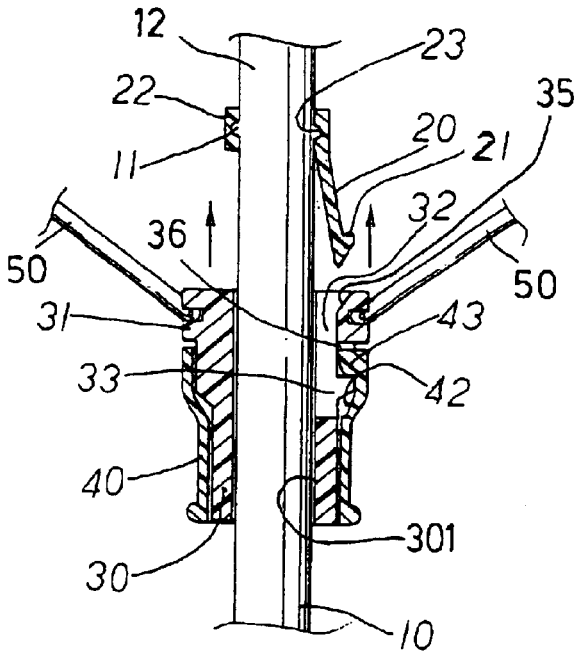
FIG. 3 is a partial cross sectional view of the runner lock device, taken along lines 3—3 of FIG. 1.

Referring to the drawings, and initially to FIGS. 1–4, a runner lock device for umbrella in accordance with the present invention comprises a central post 10 including one or more nibs or projections 11 provided thereon or extended radially and outwardly from the outer peripheral portion 12 thereof.

A retainer device 20 includes a hook or a retainer member 21 extended from a ring member 22 which is engaged onto the central post 10 and which includes one or more cavities 23 formed in the inner peripheral portion thereof to receive the projections 11 of the central post, and thus to secure the retainer device 20 onto the central post 10.

Alternatively, the retainer device 20 may include one or more nibs or projections (not shown) provided thereon or extended radially and inwardly from the ring member 22, to engage into the corresponding holes or cavities (not shown) of the central post 10, and thus to secure the retainer device 20 onto the central post 10.

A cylindrical barrel 30 is slidably engaged onto the central post 10, and includes, for example, a bore 301 formed therein to slidably receive the central post 10 therein, and thus to slidably engage the cylindrical barrel 30 onto the central post 10. The barrel 30 includes a number of notches 31 formed in the outer peripheral portion thereof to attach whale bones or ribs 50 therein (FIGS. 3–7).

The barrel 30 includes a channel 32, such as a vertical channel 32 formed therein, and an inclined surface 35 formed or provided in the upper portion of the channel 32 thereof, to receive and guide the retainer member 21 of the retainer device 20 into the channel 32 of the barrel 30. The barrel 30 further includes an opening 33 formed therein and communicating with the channel 32, to receive the retainer member 21 of the retainer device 20, and thus to latch or lock the barrel 30 to the retainer device 20, and thus to the central post 10, best shown in FIGS. 3 and 5.

Figure 4:
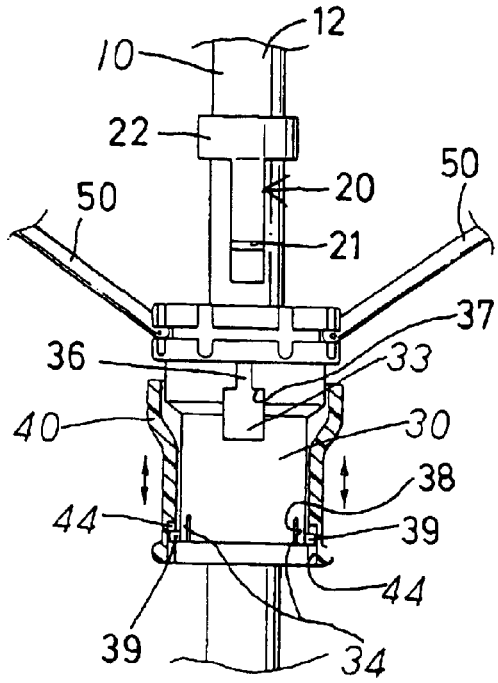
FIG. 4 is a partial cross sectional view of the runner lock device, similar to FIG. 3, in which the inner barrel has not been cut off.
Figure 5:
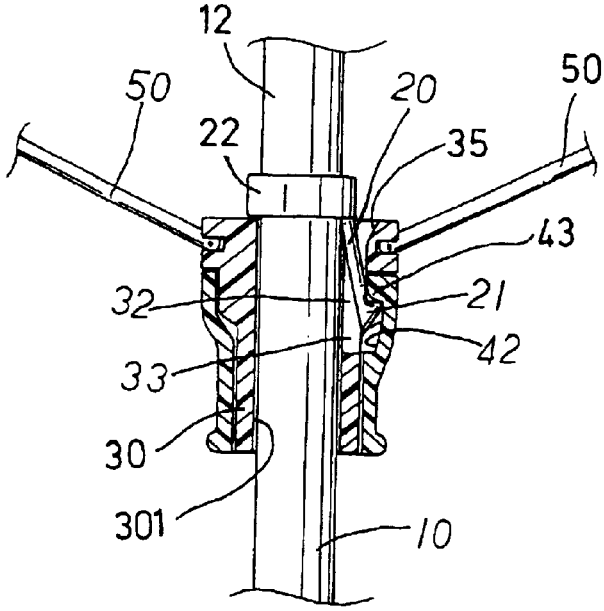
FIGS. 5, 6, 7 are partial cross sectional views of the runner lock device, similar to FIG. 3, illustrating the operation of the runner lock device for the umbrella apparatus.

As best shown in FIGS. 2 and 4, the barrel 30 further includes a groove 36 formed therein and communicating with the opening 33 thereof, and having a width smaller than that of the opening 33 thereof, to form or define one or more shoulders or seats 37 in the barrel 30 and/or between the opening 33 and the groove 36 of the barrel 30. The retainer member 21 of the retainer device 20 may engage with the seats 37 of the barrel 30, to latch or lock the barrel 30 to the retainer device 20, and thus to the central post 10

The barrel 30 further includes one or more spring blades 34 formed in the bottom portion thereof and defined by slots 38 or the like, to increase the resilience of the bottom portion of the barrel 30, and includes a catch 39 extended from each of the spring blade 34 for catching or latching purposes, which will be described in further details hereinafter.

A sleeve 40 is further provided and slidably engaged onto the central post 10 and the cylindrical barrel 30, and includes a bore 49 formed therein to slidably receive the cylindrical barrel 30 and the central post 10. The sleeve 40 includes one or more passages 44 formed therein (FIGS. 2, 4) to slidably receive the catches 39 of the spring blades 34 of the barrel 30, and thus to latch or retain the sleeve 40 to the barrel 30.

As best shown in FIG. 4, the passages 44 of the sleeve 40 includes a height or length greater than the height of the corresponding catches 39 of the spring blades 34, to allow the catches 39 of the spring blade 34 to slightly move up and down relative to the sleeve 40, or to limit the up and down movement of the sleeve 40 relative to the barrel 30.

The sleeve 40 includes a recess 42 formed therein, and preferably aligned with the opening 33 of the barrel 30, to receive the retainer member 21 of the retainer device 20, and includes a protrusion or an actuator 43 extended therefrom and engageable into the groove 36 of the barrel 30, such that the actuator 43 of the sleeve 40 may also be engaged with the retainer member 21 of the retainer device 20 (FIG. 5), to further solidly latch or lock the barrel 30 to the retainer device 20, and thus to the central post 10

Figure 7:
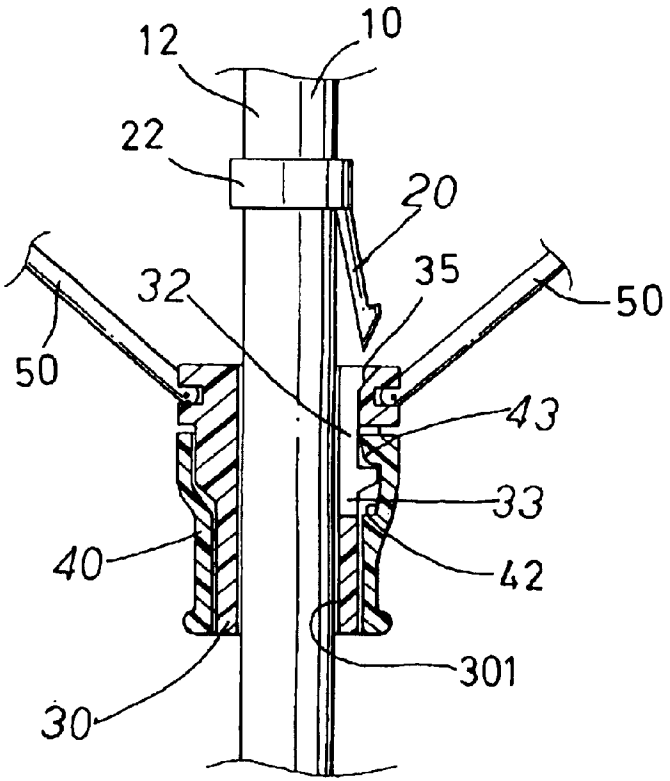
Figure 6:
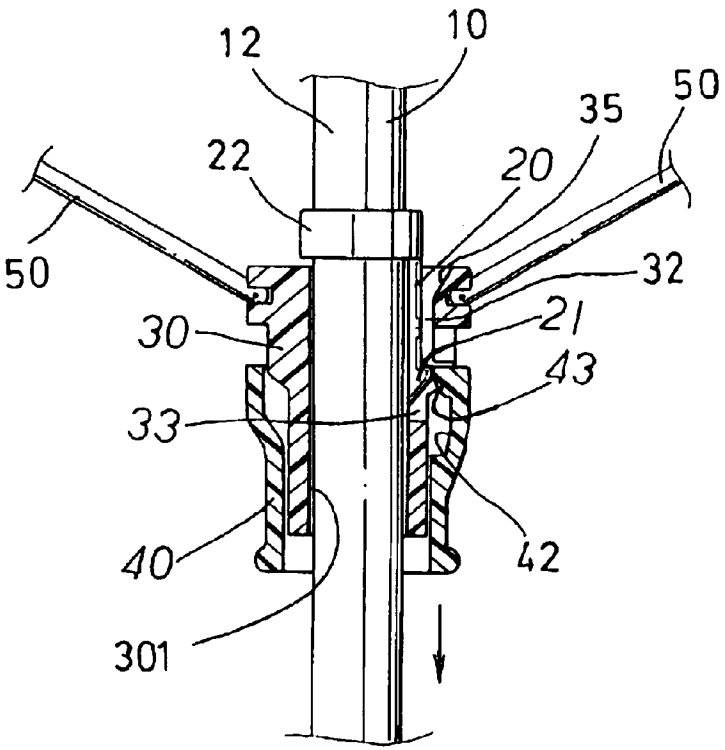

When the sleeve 40 is pulled or moved downwardly relative to the barrel 30 by such as the users, as shown in FIGS. 6, 7, the actuator 43 of the sleeve 40 may be caused or forced to move along the groove 36 of the barrel 30, and may be moved into the opening 33 of the barrel 30, to engage with and to move or disengage the retainer member 21 of the retainer device 20 out of the opening 33 and the seats 37 of the barrel 30, such that the barrel 30 may be released from the retainer device 20, and thus may be released from the central post 10.

The sleeve 40 or the actuator 43 of the sleeve 40 may thus be used as a device or means to selectively or optionally disengage the retainer member 21 of the retainer device 20 out of the opening 33 and the seats 37 of the barrel 30, and thus to release the barrel 30 from the retainer device 20 and the central post 10, when required, or when the sleeve 40 is pulled or moved relative to the barrel 30.

It is to be noted that none of the prior umbrella apparatuses teach to provide a hook or a retainer member 21 on the outer peripheral portion 12 of the central post 10, to allow the retainer member 21 to be easily and quickly secured onto the central post 10, and to prevent the central post 10 from being drilled with holes therein, such that the strength of the central post 10 will not be decreased.

In addition, no spring members or latches or catches are required to be engaged into the central post 10, such that the runner lock device may be easily and quickly secured onto the central post 10 of the umbrella apparatus.

Accordingly, the runner lock device for umbrella in accordance with the present invention includes a hook or retaining member which may be easily and quickly attached and secured onto the outer portion of the central post, and the central post is not required to be formed with openings or holes therein to receive spring members and latches or catches, such that the strength of the central post will not be decreased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A runner lock device for umbrella comprising:

a central post including an outer peripheral portion, a retainer device attached onto said outer peripheral portion of said central post, a barrel slidably engaged onto said central post, and including an opening formed therein to receive said retainer device, and thus to latch said barrel to said retainer device and thus to said central post, and means for disengaging said retainer device from said barrel, to release said barrel from said central post, said disengaging means including a sleeve slidably engaged onto said barrel and having an actuator arranged to engage with said retainer device and to disengage said retainer device from said barrel.

2. The runner lock device for umbrella as claimed in claim 1, wherein said retainer device includes at least one cavity formed therein, said central post includes at least one projection extended from said outer peripheral portion thereof to engage into said at least one cavity of said retainer device, and to secure said retainer device to said central post.

3. The runner lock device for umbrella as claimed in claim 2, wherein said retainer device includes a ring engaged onto said central post.

4. The runner lock device for umbrella as claimed in claim 1, wherein said barrel includes a channel formed therein, and communicating with said opening of said barrel, to guide said retainer device into said opening of said barrel.

5. The runner lock device for umbrella as claimed in claim 4, wherein said barrel includes an inclined surface provided in an upper portion of said channel thereof, to guide said retainer device into said channel of said barrel.

6. The runner lock device for umbrella as claimed in claim 1, wherein said barrel includes a groove formed therein and communicating with said opening thereof to slidably receive said actuator of said sleeve.

7. The runner lock device for umbrella as claimed in claim 6, wherein said groove of said barrel includes a width smaller than that of said opening of said barrel, to form at least one seat between said groove and said opening of said barrel, and for engaging with said retainer device.

8. The runner lock device for umbrella as claimed in claim 1, wherein said sleeve includes a recess formed therein and aligned with said opening of said barrel to receive said retainer device.

9. The runner lock device for umbrella as claimed in claim 1, wherein said barrel includes means for limiting a movement of said sleeve relative to said barrel.

10. The runner lock device for umbrella as claimed in claim 9, wherein said limiting means includes at least one catch extended from said barrel to engage with said sleeve, and to limit the movement of said sleeve relative to said barrel.

11. The runner lock device for umbrella as claimed in claim 10, wherein said sleeve includes at least one passage formed therein to slidably receive said at least one catch of said barrel.

12. The runner lock device for umbrella as claimed in claim 11, wherein said at least one passage of said sleeve includes a height greater than that of said at least one catch of said barrel, and thus to slidably receive said at least one catch of said barrel.

13. The runner lock device for umbrella as claimed in claim 10, wherein said sleeve includes at least one blade formed therein and defined by at least one slot, and having said at least one catch extended therefrom.

* * * * *